United States Patent [19]

Atkinson et al.

[11] Patent Number: 5,001,317

[45] Date of Patent: Mar. 19, 1991

[54] FLUID ACTIVATED SWITCH APPARATUS

[75] Inventors: Louis D. Atkinson, 12535 W. Wilbur Dr., New Berlin, Wis. 53151; Terence T. Smith, Milwaukee, Wis.

[73] Assignee: Louis D. Atkinson, New Berlin, Wis.

[21] Appl. No.: 374,241

[22] Filed: Jun. 30, 1989

[51] Int. Cl.[5] ..... H01H 35/34

[52] U.S. Cl. ..... 200/834; 73/723; 200/83 P; 200/302.1

[58] Field of Search ..... 340/626; 307/118; 73/715, 716, 717, 723; 337/318–320; 200/83 S, 83 P, 83 R, 83 A, 83 Y, 83 N, 81.4, 302.1

[56] References Cited

U.S. PATENT DOCUMENTS

| | | | |
|---|---|---|---|
| 3,436,502 | 4/1969 | Egli | 337/320 |
| 3,535,480 | 10/1970 | Bahniuk | 200/83 P |
| 3,862,387 | 1/1975 | Phillips et al. | 200/83 N |
| 4,081,638 | 3/1978 | Rice | 200/834 |
| 4,267,413 | 5/1981 | Reis | 200/834 |
| 4,330,695 | 5/1982 | Poling | 200/83 P |
| 4,456,801 | 6/1984 | Lauritson | 200/83 P |

*Primary Examiner*—Gerald P. Tolin

*Attorney, Agent, or Firm*—Andrus, Sceales, Starke & Sawall

[57] ABSTRACT

A pneumatic switch unit includes a switch housing. A conductive contact spring is mounted between diametric supports, one being adjustable. The spring has a central actuator arm and an offset contact arm interconnected to an encircling frame. A two piece switch actuator has clamp members clamped to the actuator arm. Separate end closure members secured to the switch housing ends. The closure member may clamp a diaphragm against the housing, with the diaphragm engaging the actuator. The closure member may have a mechanical actuating member or a simple closure plate engaging the actuator. The two switch housings may be mounted to the opposite sides of a single pressure chamber with end diaphragms closing the opposed ends of the switch housing. The pressure actuates both switch units to establish a sequence switch unit. The spring has a rectangular frame with a central opening having an actuating arm therein. The opposite spring ends are mounted in supports one of which is adjustable. A contact arm is secured to one end and projects parallel to the side. The opposite spring corner includes a notch to control the snap action. An alternate spring has an annular ring with a chordal actuator arm and a chordal contact arm. The spring is mounted on a line perpendicular to the two arms.

14 Claims, 4 Drawing Sheets

FIG. 7
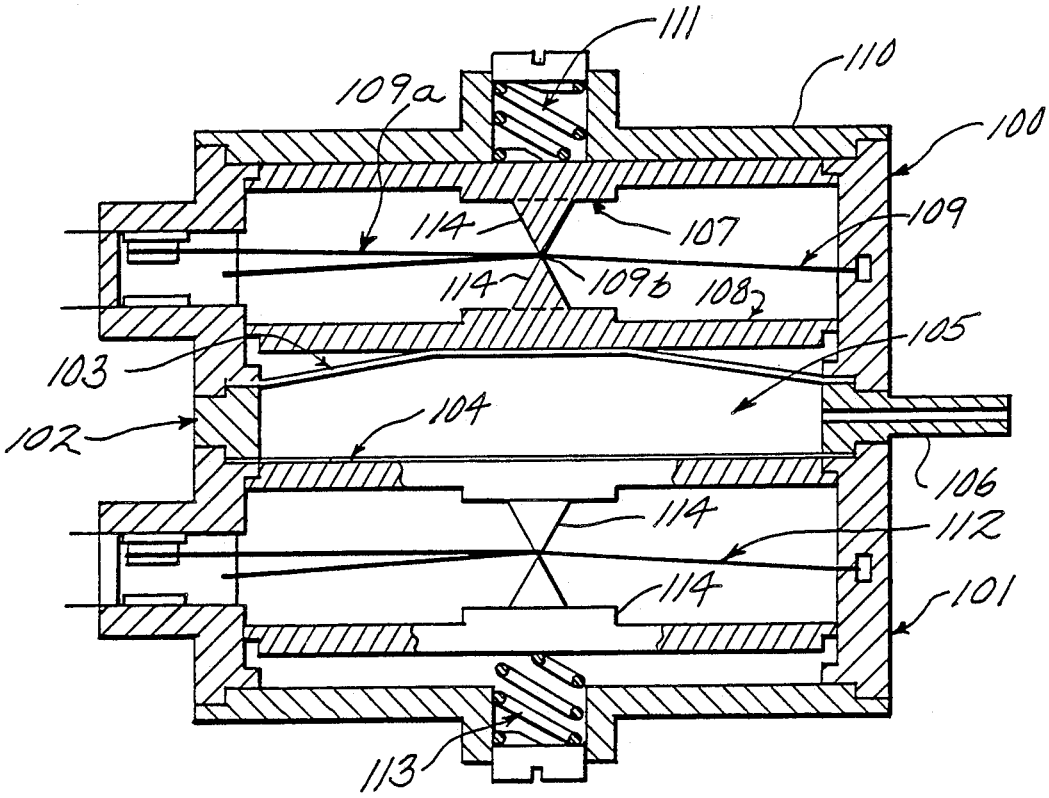
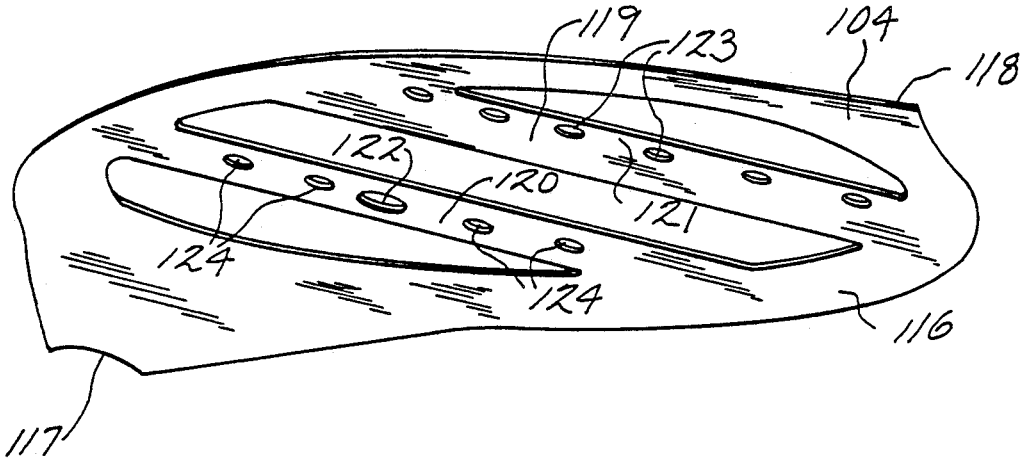
FIG. 8

FLUID ACTIVATED SWITCH APPARATUS

BACKGROUND OF THE PRESENT INVENTION

This invention relates to a fluid responsive or activated switch apparatus and particularly to a pressure responsive switch apparatus which can be used in various application, including a differential pressure switch.

In various control and operating systems, fluid signals and particularly pneumatic signals or pressures are sensed. Various controls and operations are established in accordance with the sensed signals. A pressure signal transducer is widely used to control electrical circuits in accordance with the sensed fluid signals. Thus, a pressure-to-electrical transducer may include a pressure chamber having a diaphragm positioned by the pressure signal and coupled to a switch apparatus for actuating of an electrical control such as a switch unit. The output can provide a proportional change or instantaneous change between an open and closed state unit. In a snap action system, various spring loaded switch members are used such that the diaphragm moves a switch part to a selected stressed position at which time the structure is such that the switch part and a coupled electrical component moves rapidly to an alternate switch position, converting the switched state from its then state to an alternate state instantaneously. Various forms of switch structures have been disclosed and are available with such snap actions. Generally, such switch structures have limited application in that each switch design is particularly tailored to a particular function or response.

SUMMARY OF THE PRESENT INVENTION

The present invention is particularly directed to a diaphragm switch structure of a modular construction which permits the assembly of the switch unit for various responses including a differential pressure set point, a single pressure response set point, with or without adjustable pressure setting, a sequenced pressure responsive switch apparatus and the like..

Generally, in accordance with the teaching of the present invention, the switch apparatus includes a switch chamber unit isolated from the pressure chamber unit by a common wall unit. In one aspect of the invention, the switch apparatus includes at least first and second opposite end modules interconnected to a central or intermediate switch module. A diaphragm unit forms the common wall between at least one of the end units and the common intermediate module. A pressure fluid signal is coupled to the one end module to position the common wall diaphragm for actuating a switch mechanism within the intermediate switch module. The switch mechanism includes a flat contact spring secured within the center or intermediate module and carries a contact lever member for snap action movement with respect to one or more fixed contacts coupled to and within the intermediate module. The flat contact spring has an actuated lever unit coupled to the contact lever and moved by the movement of the diaphragm to deflect the contact lever member. The contact spring is specially mounted and may be set to provide a snap action movement or a progressive movement of the contact lever member.

A particularly practicle embodiment of the present invention includes a generally rectangular two piece contact spring housing. Each of the housing members includes a generally rectangular base portion with a corresponding spring guide opening. Each housing member is also provided with circumferentially spaced inward housing walls which complement and mate with each other with the housing secured in abutting relation to define an inner spring chamber. Diametric opposite walls of the one housing member are provided with spring end supports at least one of which is adjustable to very the spacement between the supports. A flat low tie arm spring has in line opposite mounting end members which releasably engage the spring supports. The spring length is greater than the spacement between the supports and thus forms an arched configuration within the spring chamber. A two piece actuator is movably mounted within the through opening of the housing members with actuator members located to the opposite side of the spring and with a generally centrally located elements on the actuators in clamping engagement with an actuating arm in the multiarm spring member. Axial movement of the actuator provides corresponding movement of the actuator spring arm relative to the supports. The arm movement deflects the spring relative to the supports and creates a snap action movement. The spring is a conductive member and further concludes a side contact arm the outer end of which is located in a contact chamber. The snap action movement of the spring member correspondingly moves the contact arm to open and close contacts located within the contact chamber. The opposite exterior end walls of the two housing members are correspondingly shaped to receive correspondingly shaped end closure members or units. The end closure units can include diaphram hooks for closing of the spring chamber with the diaphram in engagement with the adjacent actuator. The corresponding closure unit includes a pressure chamber divide a pressure responsive control of the switch of the contact spring member and thereby establishing a pressure responsive switch unit. Other end closure members of units can provide for mechanical positioning of the adjacent actuator member or simply close the corresponding end of the switch unit with the opposite side providing for input control of the switch unit. In addition, the modular switch unit can be mounted between a common pressure chamber with diaphrams closing the opposite side ends or the opposing facing ends of the two switch units to establish a sequential multiswitch assembly. The exterior ends of the two switch units are again closed with any suitable end closure unit depending upon the particular switch function.

The present invention thus provides a significant improvement particularly applicable to miniturized low pressure sensing of any suitable fluids including liquids, gaseous mediums such as air and other gases, as well as combinations of such mediums or fluid systems.

Although the invention can employ any suitable or desired spring member a particularly unique and satisfactory spring unit includes a generally rectangular frame with a center opening. The actuating arm is integrally formed with an end member of the frame and projects into the opening of the frame. A contact arm is secured to the opposite end member adjacent the side and projects outwardly and parallel to the side frame. The inventors have discovered that the snap action can be improved by providing a control notch or offset in the connection between the side frame arm opposite from the contact arm at its connection to the end member opposite the end member connection to the contact arm. Thus the notch is formed in the diametric opposite corner of the generally rectangular frame from the connection of the contact arm. The size and location of the notch affects the particular response characteristic. A further spring structure which has been found to provide a particular advantageous inter-reaction includes a generally circular or annular frame with first and second spaced chordal arm members connected to opposite sides of the frame and extended as a continuous member across the frame. One member is aligned with the actuator and the contact is secured to the second diametric spaced contact arm. Again the deflection of the actuator chordal arm by the actuator within the switch chamber deflects the spring frame and creates a corresponding snap action movement of the contact arm. The circular frame includes radial mounting projections on diametric opposite sides or edges on a line substantially perpendicular to the parallel actuator arm and contact arm.

The present invention thus provides a readily constructed switch unit using present day technology and materials and techniques. The present invention also provides particularly unique spring members for providing various responses of the switch unit including both proportional and snap action responses based on appropriate mounting of the spring members with the basic switch unit readily coupled to various control modules or elements.

BRIEF DESCRIPTION OF THE DRAWINGS

The drawings furnished herewith illustrate the best mode presently contemplated for the invention and are described hereinafter.

In the drawings:

FIG. 7 is a sectional view similar to FIG. 3 illustrating an alternate embodiment of the invention applied to a series sequence control switch; and FIG. 8 is a view similar to FIG. 4 illustrating an alternate spring unit adapted to be mounted as a part of the embodiments of a switch structure shown in FIGS. 1–7.

DESCRIPTION OF THE ILLUSTRATED EMBODIMENT

Figure 1:
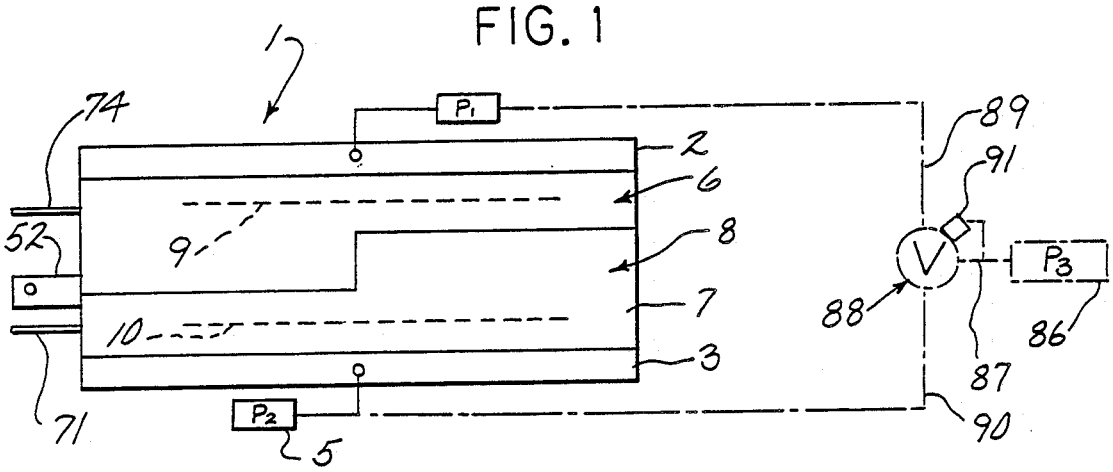
FIG. 1 is a side elevational view of a miniaturized low pressure differential switch connected to a pair of pressure sources.
Figure 2:
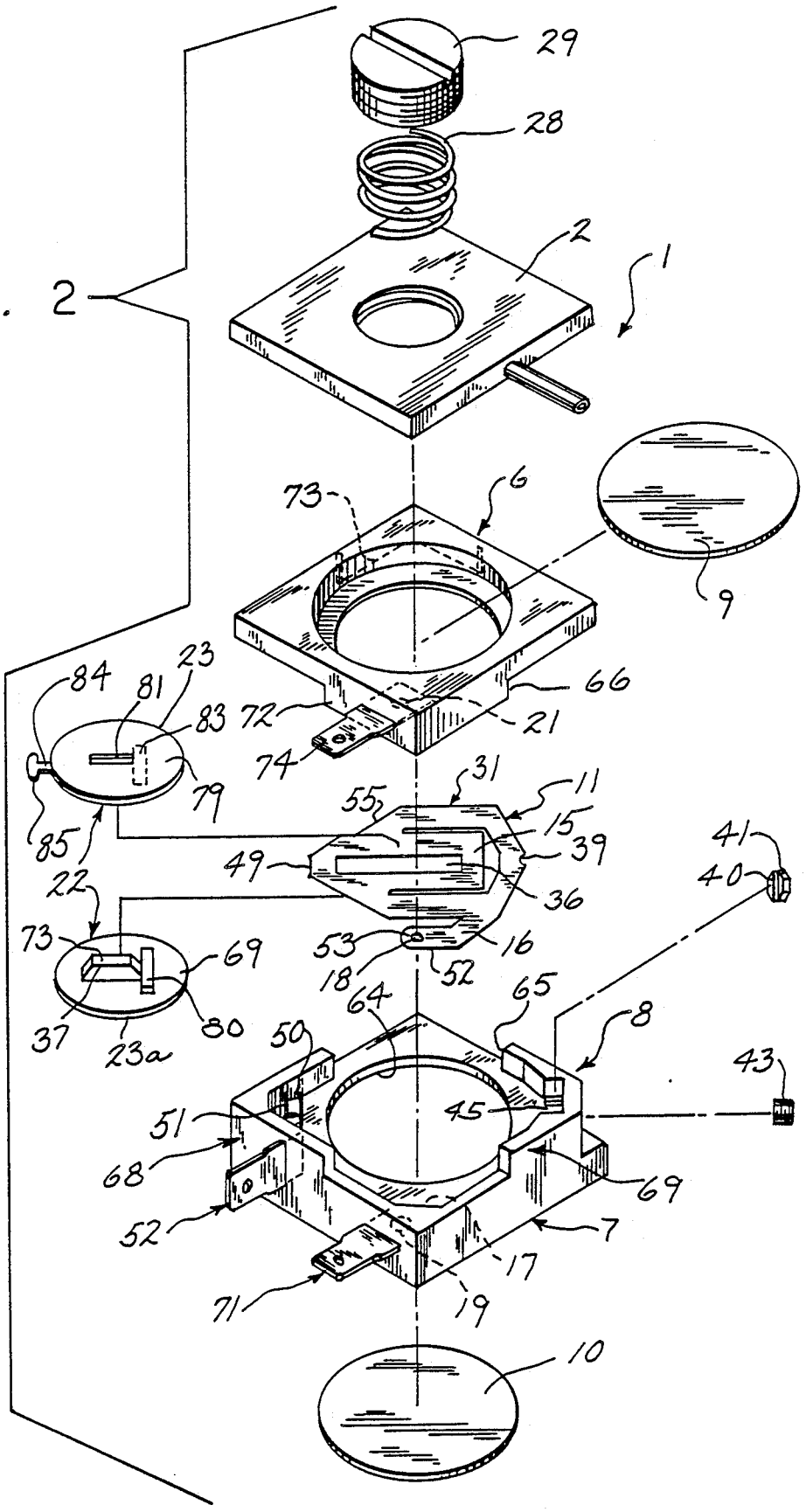
FIG. 2 is an exploded view of the switch shown in FIG. 1 to show inner detail of construction.

Referring to the drawings and particularly to FIGS. 1 and 2, a pressure differential switch unit 1 is illustrated having a first signal input pressure plate 2 and a second signal input pressure plate 3 connected respectively to pressure signal sources 4 and 5. The illustrated pressure differential switch unit 1 includes an intermediate wall switch unit 8 having a substantially rectangular housing formed by a complementing wall members 6 and 7 interconnected in sealed relation. The pressure plates 2 and 3 are secured to the end faces of the members 6 and 7. Diaphragms 9 and 10 are similarly secured as a common wall between the opposite ends of switch unit 8 and each of the end pressure plates 2 and 3, respectively. As more clearly shown in FIGS. 2 and 3, a contact spring 11 is located generally centrally of the inner wall 12 of the wall unit 8, and particularly housing member 7. The contact spring 11 is formed as a substantially flat planar member of a suitable spring contact material and with an unstressed length greater than the inner diameter or width of the supporting intermediate wall unit 8. The contact spring 11 is any suitable conductive material but is preferably formed of a beryllium copper which is widely used in connection with spring contacts and the like. The material provides a high degree of resiliency over long periods of use in many cycles of operation. The material is a good conductor of electricity and provides a very low resistence interconnection within the circuit and the contacts. The contact spring 11 is a multiple armed member having spaced mounting ends and an actuator lever arm 15 for moving the spring 11, and a contact arm 16 moved in response to the movement of the lever arm 15. The spring 11 is secured to opposite sides of wall unit 8, and has an arched configuration within the switch housing. The contact arm 16 is secured offset from the center of the spring and thereby the housing and projects into a switch section or chamber 17 integrally formed or otherwise secured within the sidewall of the intermediate wall unit 8. With the spring located in the illustrated full-line arch position of FIG. 3, a contact 18 on the end of the contact arm 16 engages a first fixed contact 19 within the contact chamber 17. Movement of the contact spring 11 to the opposite side of a plane 20 through the wall mountings of the contact spring 11, as shown in phantom in FIG. 3, results in the positioning of the contact arm 16 and the movable contact into engagement with an alternate or second fixed contact 21 in housing member 6 and in the path of arm 16. A spring and switch plunger or actuator 22 includes a pair of coupling members 23 and **23*a* located to the opposite sides of the contact spring 11 and coupled to the actuator lever arm 15 to position the spring 11 and the contact arm 16. The coupling members 23 and 23*a* are coupled to the respective diaphragms 9 and 10** for controlled positioning thereof.

The contact lever arm 16 is alternately positioned between the full line and phantom line position in response to the differential pressure signals applied at the signal inlets 2 and 3 and thereby to the diaphragms 9 and 10.

In the embodiments of FIGS. 1–4, the pressure chambers 24 and 25 and spring positioning controls are located symmetrically about the plane to the opposite sides of the mounted ends of contact spring unit 11.

Figure 3:
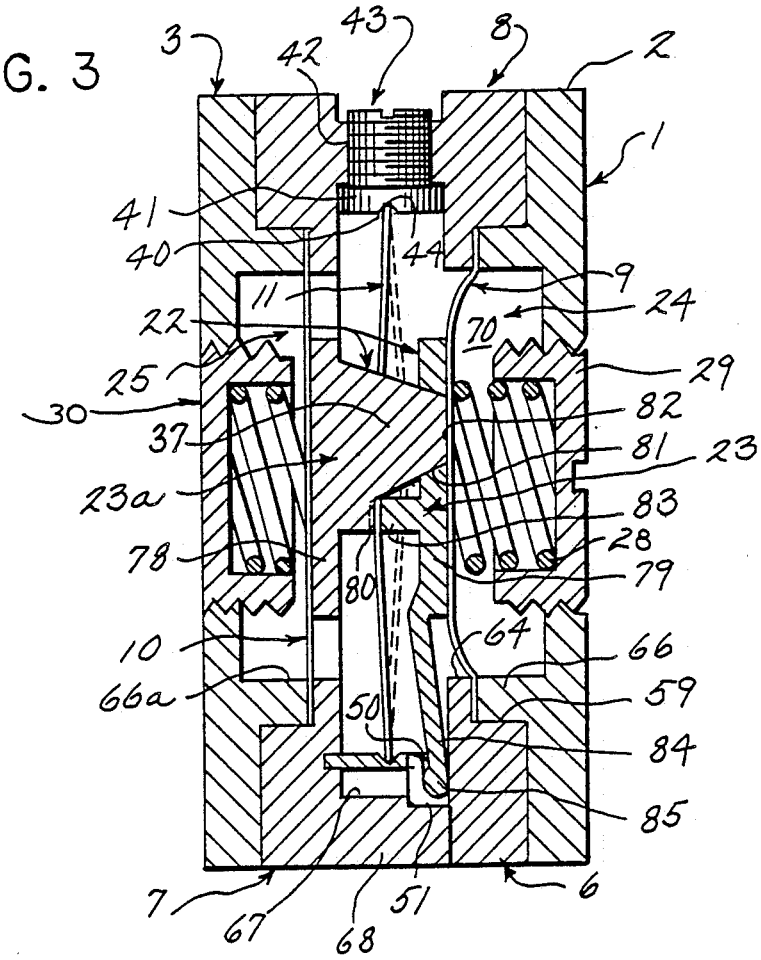
FIG. 3 is a vertical sectional view of the switch shown in FIGS. 1 and 2.

Referring to the right side of the drawing as viewed in FIG. 3, a resilient and flexible diaphragm 9 is shown clamped spanning the internal chamber assembly within the housing with the peripheral edge clamped to the housing to form the pressure chamber 24 within the end unit 6 to the exterior of the diaphragm 9. The diaphragm is impervious to fluids and is preferably secured in place to hermetically seal the pressure chamber. Although shown as having a significant flexible characteristic, other relatively rigid diaphragms such as Nylon and Mylar plastic as well as metal diaphragms which have been generally used in other applications can be used in the present invention. The position of the diaphragm 9 and particularly the center portion thereof is of course directly related to the opposing forces applied to the diaphragm 9. The switch actuator or coupling member 23 is a disc-like member slidably mounted within the intermediate switch or wall unit 8 and opposing the pressure forces on diaphragm 9. The opposite face of the member 23 is coupled to the actuator lever arm 15 of the contact spring 11. The contact spring 11 resiliently establishes the opposing force on the member 23 and diaphragm 9.

In the illustrated embodiment, a preload coil spring 28 is located within the outer housing end unit 6 and projects inwardly into compressed abutting engagement with the diaphragm 9. The force of the spring 28 is shown with an adjustable control through an adjustable member 29 threaded in the end wall unit 6 for purposes of illustration. The coil spring 28 establishes an initial force biasing diaphragm 9 inwardly and tending to move the switch actuator member 23 and the interconnected contact spring 11 to the right as viewed in FIG. 3.

The switch assembly to the opposite side of the contact spring 11 is essentially identically formed. Thus, to the opposite side of the contact spring, member 23*a* is slidably journaled within the intermediate wall unit 8. Diaphragm 10 is clamped to span the housing abutting the planar backside of the member 23*a*, and preferably hermetically seals the chamber 25. The diaphragm 10 thus defines a pressure chamber 25 coupled to the second pressure inlet 3, and in the illustrated embodiment, to the second diagrammatically illustrated pressure source 5. An adjustable coil spring and nut assembly 30 is provided in the opposite end pressure plate 3 for corresponding adjustment of a prestressing force on the diaphragm 10 and member 23*a*.

In operation, the setting of the coil springs 28 and 30 provide a preload on the diaphragms 9 and 10 and thereby establish a relative position of the members 23 and 23*a* and coupled contact spring 11. The pressure signals in the chambers 24 and 25 are added to the force of the coil spring assemblies 28 and 30 and provide a net force to the associated actuator. The positioning of the actuators 23 and 23*a* and therefore the contact spring 11 is directly related to and controlled by the differential pressure applied to the respective differential pressure chambers 24 and 25 to provide the desired switch movement. In the illustrated embodiment, the pressure differential is thus set by the coils springs 28 and 30'.

The force generated within the spring 11 as the result of the arched mounting is directly related to the offset which is created by the difference in the length between the mounting ends of the contact spring 11 and the length of the spaced mounting elements of intermediate wall unit 8 to which it is secured. The arched contact spring 11 creates a resistent force which must be overcome by the actuator located to the convex side of the contact spring 11. Thus, the greater the difference between the contact length and the distance, the greater the outward force created in the plane of the contact spring and the effective resistence to movement. The resistance can of course be adjusted by varying of the length of the spring and/or the diameter of the housing.

Creating a pressure in chamber 25 to overcome the pressure and the opposed coil spring forces on actuator 23, moves actuator 23 and the contact lever arm 15 of the contact spring 11 without movement of the contact arm 16. As the lever arm 15 moves pass the plane through the mounting positions, the spring forces within the contact spring and creates a snap action force causing the spring to move and arch to the opposite or phantom line position, carrying the contact arm 16 to reverse the position of the common contact 18 from contact 19 to engage the alternate contact 21.

As more fully developed hereinafter with a preferred contact spring construction, the switch apparatus can be made to operate with an automatic return to the full line position upon release of the pressure from the diaphragm pressure chamber 25 or can be made to maintain its switched position until an opposite differential pressure is created sufficient to move the contact lever past the switching plane to create a snap-action movement to the full line position in FIG. 3.

Generally, the switch apparatus can also provide a non-snap action movement. If the contact support length or distance of unit 8 is exactly equal to the mounting length of the contact spring, there is no initial spring force or resistence. The actuator force applied spring actuator arm 15 simultaneously moves the contact arm 16 of the spring 11. There will thus be some intermediate position of the actuator and a coupled spring holding of the contact intermediate and in spaced relation to the contacts. The closed position with either contact will be controlled by the relative setting of the springs and the pressure applied to the opposed pressure chambers.

The symmetrical mounting and construction of the assembly particularly adapts the switch unit to a universal switching concept for operation with other switch assemblies which are readily constructed with the basic components illustrated in the first embodiment as more fully described hereinafter.

Figure 4:
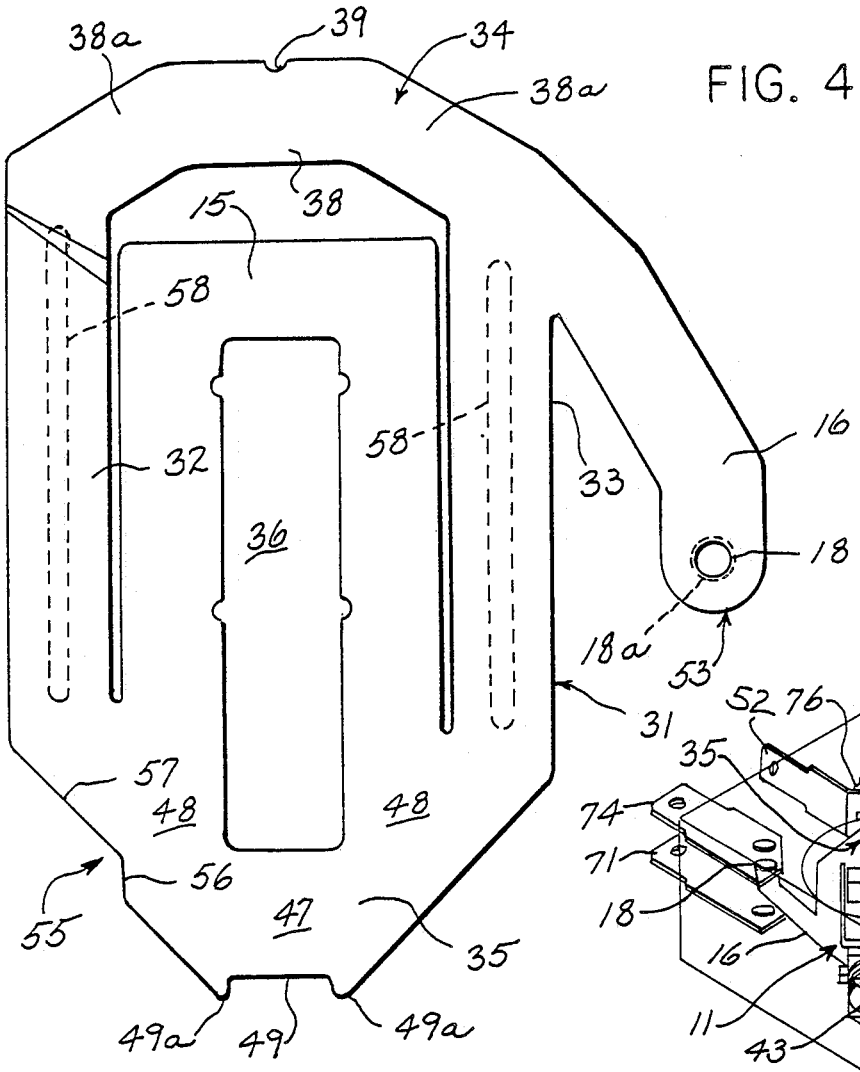
FIG. 4 is a plan view of a contact spring unit shown in FIGS. 1–3.
Figure 5:
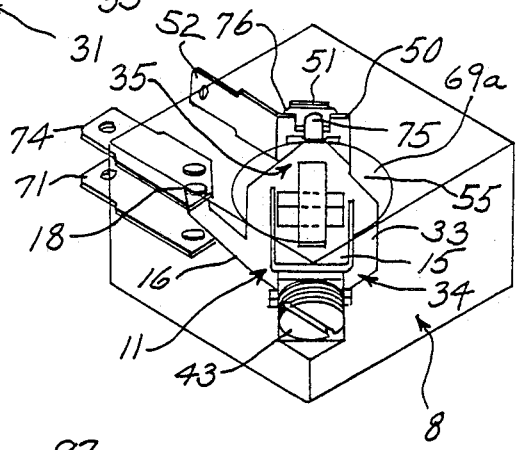
FIG. 5 is a view taken generally on line 5—5 of FIG. 3 and illustrating the mounting of one end of a contact spring unit shown in FIGS. 1–4.

As more clearly shown in FIG. 4, the spring member 11 includes the outer rectangular frame 31 of a substantially constant cross section in the side arms or members 32 and 33. The opposite ends 34 and 35 connect the side members 32 and 33 with the side members spaced substantially from each other, and in the illustrated embodiment of the invention, by about a factor of three times the width of a side frame member 32. The deflection arm 15 is integrally formed with the one end 34 and projects inwardly into the opening between the side members 32 and 33. The deflection arm 15 is generally a U-shaped member integrally joined at the free ends within the one end 35 and defines a central opening 36, shown generally of a width somewhat greater than the width of the side members. The central opening 36 is constructed to receive a guide element 37 of the spring actuating plunger assembly 22, which is coupled to the deflection arm 15 for deflecting thereof and positioning the spring member between alternate limit positions as more fully developed hereinafter.

The opposite ends 34 and 35 of the spring member 11 are secured in fixed relation, with only such movement permitted as required to permit the snap action movement between the opposite curved limits from the center mounting plane.

The first end 34 of the frame member 31 is formed with the slightly U-shaped configuration including a central linear base 38 connected to the side members 32 and 33 by linear portions 38*a*. The outermost edge of the first end member 34 is provided with a small locating notch 39. The first end 34 of the spring member 11 rests within a groove 40 in an adjustment set plate 41. In the illustrated embodiment of the invention, the intermediate wall unit 8 includes a threaded opening 42 in alignment with the spring member 31. A screw 43 threads into the threaded opening into abutting engagement with the back side of the set plate 41. The set plate 41 has the groove 40 mating with the notched end of the frame. A slight projection 44 within the notch mates with the small recess or notch 40 in the edge of the frame end. The plate 41 is guided within a grooved portion 45 of the intermediate wall unit to permit linear movement and setting of the plate in accordance with the threaded positioning of the adjustment screw 43. The positioning of the adjustment screw 43 varies the spring mounting length or distance within the spring housing between the end frame supports and creates a tension control within the arched spring member 11.

The opposite end of the spring member 35 is frustoconically or generally deeper U-shaped with a small linear base 47 and longer side wall portions 48. The base 47 includes a generally rectangular notch 49 with outer smooth corner portions. The notch or recess preferably included inclined side wall portions 49*a* having a slight angle of inclination shown as approximately 10 degrees. The end rests within a generally V-shaped contact walls 50 of a power terminal 52 located in the diametrically opposite corner of the housing unit 8. The walls 50 includes a pair of spaced V-shaped walls 50 with an L-shaped wall 51 projecting outwardly therebetween. The spring member 11 is located with the base of the recess or notch 49 abutting the walls 50 and the opposite inclined side edges 49*a* abutting the sides of the two walls to provide support of the spring member with a limited pivotal and linear movement of the spring member 11.

The spring member 11 is formed as a flat planar member. When assembled with the switch wall unit 8, the frame 31 is deflected as a result of the relative length between the opposite end edges of the frame 31 and the opposite corners dimension and particularly the diametric end receiving end recesses of the housing. The spring arm 15 is generally located in a planar position and interconnected to the plunger assembly 22 for positioning of the spring member 11 between its limit positions.

The contact arm 16 of the spring member 11 is secured to the one side of the rectangular frame 31 and to the end member 34. The contact arm 16 extends outwardly generally at an angle somewhat less than the angle of the end side portion of the spring member and terminates in a contact tab 53 lying substantially parallel to the side members 32 and 33 of the spring frame 31. The contact tab 53 has button contacts 18 and 18*a* on its opposite faces. The contact arm 16 and contacts have one of two possible positions in a dual contact system as illustrated.

More particularly, deflection of the spring lever arm 15 results in a tensioning in the frame side members 32 and 33 and the deflection thereof until the spring member is moved to a snap over position at which time the frame side members and the contact arm 16 snap from it set to an alternate position reversing the position of the contact. The movement can be set to establish a monostable mode or a bistable mode of the arm position. Thus, in a monostable position, the arm 16 will continuously tend to return to its original position and require positive force on the plunger unit 22 and the spring lever arm 15 to maintain the alternate positioning of the contact arm 16 and associated contacts 18 and 18*a*. In a bistable mode, the arched spring 15 will maintain its last position and require a positive returning force on and reverse positioning of the spring lever arm 15 to an opposite over center position to effect a return of the spring to prior or first position.

In the illustrated embodiment of the invention, the side frame 32 and end member 35 opposite the contact arm 16 is specially formed with a inward slight offset or notch 55 at the interconnection of end member 35 to the side member 32. The notch 55 includes an inwardly step portion 56 in the end member to an inclined connecting portion 57 to the side member 32. The offset and notch structure has been found to provide an improved snap action movement of the contact arm. It thus appears that there is a slightly different tension action in the two side members 32 and 33 of the frame 31. The notched portion tends to initiate a snap action which is then accelerated and added to by the non-notched side arm to provide an instantaneous movement of the non-notched side arm and the contact arm. Thus, once the spring frame member and contact arm initiate a change-over position, the action is completed without any momentary delay or time required and a smooth rapid snap action movement of the contact arm results.

In addition, the flexibility of the side frame members 32 and 33 can be further controlled by providing appropriate openings 58 within the frame member, as shown in dotted line illustrations in FIG. 4. Generally, the introduction of an opening or openings within the side members reduces the tension forces. However, as the spring member 11 constitutes a conductor for interconnecting of power from the power supply to the movable contact, care must be taken to maintain an appropriate conductive cross section for any given application. The thickness of the spring member 11 can of course also be varied and generally it is proposed in a practical application to provide a variation between 0.002 inches and 0.010 inches. The thickness will change the flexible characteristic of the material and consideration must be given to appropriate maintainence thereof.

The illustrated contact spring 11 also has the ability to recoil; that is, reset to its original position. Thus, with the contact spring 11 moved to the alternate position, the one end 35 of the contact spring frame hinges at the two side walls or projections on the housing. As the differential pressure is relieved, the force on the lever arm 15 is relieved. The contact spring and particularly frame 31 creates an outward force as the result of the contact engagement and the contact end moves laterally of the housing with the arch moving axially of the housing until the total connecting curved edge again abutts the adjacent housing wall. As the pressure and resulting force continues to be reduced at the contact, the contact point and actuator arm move until the actuator arm has moved past the horizontal plane. At that time, the total contact spring snaps back to the original full line position illustrated, with the contact arm 16 snapping from the temporarily engaged contact back to the standby or original position.

By proper position of the cam unit, the spring is set in each position and requires a positive return force to reset the spring.

Referring again to FIGS. 2 and 3, the switch housing elements or members 6 and 7 are similarlly constructed as complementing members which when assemblied from a closed housing with the cylindrical spring chamber and outer generally flat walls. The outer face members 6 and 7 are similarly formed with an annular recess 59 to receive the end plates 2 and 3 and clamp the diaphragms 9 and 10 in plate.

Referring to member 2, a central threaded opening 60 accommodates the preset coil spring 28 which abutts the diaphragm 9. Control nut 29 is threaded into the opening 60 and presets the compression of the spring 28. Thus, in the assembled relation, the coil spring 28 and the pressure in chamber are added to apply a total force to the diaphragm 9, which is transmitted to the contact actuator assembly 22 within the switch chamber defined in the intermediate wall unit 8.

The intermediate wall unit 8 formed by the switch housing members 6 and 8 is an annular member a central opening closed by members 2 and 3. Referring to member 6, a cylindrical inner wall 64 and similar opposite stepped ends defining the recess 59, complementing a corresponding annular projection 66 on pressure plate 2. The opposite wall unit 7 and the end member 3 are similarly constructed as shown at 66*a*. The opposing faces of the members 6 and 7 are formed with mating projecting portions to define the spring chamber 35. The member 7 is a generally rectangular member having an opening 67 forming a wall of chamber 25 and L-shaped upstanding walls 68 and 69 on opposite corners of the member, thus in diametric opposite sides of the chamber 25. The L-shaped wall 68 has the terminal unit 52 embedded therein with the spring pivot walls 50 and the actuator pivot leg 51 exposed within the corner chamber, as most clearly shown in FIGS. 2 and 3. The opposite L-shaped wall 69 is similarly formed and has an enlarged corner base portion with the axial guide groove 45 within which the adjustable spring tension plate 41 is slidably disposed for positioning by the screw member 43. The one corner in housing member 6 is slightly recessed to define contact chamber 17 and has the fixed contact 19 secured to and forming a part of terminal 71 embedded within the recessed corner.

The housing member 6 as previously described has opening 64 and is formed with L-shaped corner walls 72 and 73 complementing the open corners in the member 6 between its L-shaped corner walls 68 and 69. Corner wall 72 is aligned with the open recessed corner including chamber 17. A terminal member 74 is embedded within the corner wall 72 and includes the contact 21 supported in aligned spaced relation to the contact 18. Tab 53 of spring contact arm 53 is located between the contacts 18 and 21. In the illustrated embodiment, the contact arm 16 is thus alternately positioned to engage contacts 18, 18*a* with the respective contact 19 or 21 and complete the circuit from terminal 52 to either terminal 71 or terminal 72.

The opposite corner 73 mates with the open corner between corner walls 68 and 69 of member 6 and completes and closes chamber 25. The wall 67 defines an inner constant diameter chamber 70 within which the coupling numbers 23 and 23*a* are located for guided axial movement between the diaphragm 9 and 10 and positioning of the spring lever 15.

Each diaphragm 9 and 10 is a flat flexible member in the unstressed state having a diameter corresponding to the exterior diameter of the projection and the corresponding diameter of the recess and the intermediate wall. The diaphragm is assembled with the wall structure and with the wall structure interconnected to a suitable connecting bolt or like member to firmly clamped the diaphragm in position and to hold the periphery is movably affixed to and within the housing. The diaphragm is formed of any suitable material such as used in various material. The diaphragm is shown as a resilient flexible material and is adapted to deflect inwardly into the housing for movement of the switch actuators for purposes of illustration. Each diaphragm, 9 and 10, is identically constructed and interchangeably secured within the housing and particularly the recesses 59 in the housing members 6 and 7 as most clearly shown in FIG. 3, for positioning of the actuating assembly 23.

The plunger or actuator unit 22 is illustrated including the pair of oppositely located elements 23 and 23*a*, each having a diameter essentially corresponding to the circular opening of the switch housing 18. Each of the actuator elements 23 and 23*a* includes a flat bottom plate member 78 and 79 respectively. In the illustrated embodiment of the invention, the bottom plate member 78 abuts the bottom diaphragm 10 secured within the appropriate recess portion in the lower side of the switch or spring housing. The member 78 includes a generally centrally located frusto-conical guide and coupling member 37 which extends from the plate through the opening 36 in the spring deflection arm 15. A locating plate or bar 80 is integrally formed with the plunger member at one end of the frusto-conical coupling member 37. The bar 80 provides for location of the arm 15 with a slight downward deflection when engaged with the exterior outer wall of the locating bar.

In the illustrated embodiment, the top plunger member 23 includes base plate 79 having an opening 81 and receiving the upper end of the frustoconical coupling member 37. The frusto-conical member 37 extends therethrough with the outermost edge 82 thereof in the outer plane of the top plate 79. The plate includes a depending integral locating bar 83 aligned with the locating bar 80 of the bottom plate. The bars 80 and 83 grip and hold the lever arm 15 to the opposite sides of the opening 36 and thus effectively secures the arm between the two coupling members.

The top plate 79 includes a generally T-shaped pivot arm 84 integrally formed with the plate and projecting outwardly between the spaced contact walls 50 and the L-shaped wall member 51. The cross bar 85 of the T-shaped pivot arm 84 is thereby pivotally located between the spaced walls.

The top diaphragm 9 is secured within the housing assembly abutting the planar outer face of the top plunger plate 79 and provides corresponding positioning thereof and thereby the actuator assembly in accordance with the pressure in the fixed chamber and the force of the bias spring. The lower diaphragm 10 is similarly secured abutting the bottom plunger plate 78 and similarly biases the actuator assembly in an opposite switch position.

In summary, the contact action may thus be adjusted to either a snap acting or proportional type of a contact positioning. In the snap acting mode, the contact arm 16 and thereby contacts 18, 18*a* will move at a given force to disconnect from one terminal 71 and connect to a second terminal 74. Depending upon the structure of the one end spring and spring mounting, the contact arm 16 automatically resets to the pre-bias position in response to reversal or reduction in the pressure differential or maintain its alternate position until a positive resetting force as the issue of an opposite pressure differential establishes a resetting action on the contact spring. Finally, a range of forces can be establish to activate the contact position change.

The cam unit 10 is connected to the small connecting end of the contact spring. The position adjusts the distance between which the contact is held to permit simple setting of the contact in either a snap acting mode or a simple proportional moving contact. At least resistence, the contact responds as a non-snap acting mode. As the force increases, a snap action response can be created. In a non-snap acting mode, there is a period between the reopening of the one circuit and the closing of the opposite circuit. This however provides an opening of the circuit in response to a relatively small force with closing of the alternate contact responding to the movement of the pressure to the higher levels in the range.

The present invention thus operates over a wide range of either pressure source as well as providing an adjustable differential pressure response. The apparatus can operate with any fluids including air, other gases and liquids or combinations of fluids.

The location of the electrical circuitry in the separate chamber 25 of unit 8 between two spaced pressure chambers or a pressure and a closure unit as hereinafter described, isolates the electrical power system from the pressurized medium and surrounding environment. The separation and isolation of the electrical mechanism and the pressure medium particularly permits the sensing of liquids gaseous mediums and other fluids including liquid and gas mixtures as well as combinations of such mediums, which might adversely effect the electrical mechanism. Further, the operators or actuator unit 22 with the coupling members 23 and 23*a* are formed of an insulating material to further isolate the electrical mechanism and particularly the conductive material from the diaphragms of the assembly. Similarly, the isolation of the electrical system further isolates the adjustable differential pressure control. Thus, the separate external coil spring members in either one or both of the pressurized chambers provides direct and independent pressure adjustment to both diaphragms and to both sides of the operator. The dual springs and cam unit provide dual adjustment, permitting a much wider range of tensions and a corresponding wider range of pressure differential for operating of a switch design.

The illustrated embodiment provides a highly versatile switch structure which can be used in various pressure states. Although particularly designed for a miniaturized pressure switch operating and responsive to low pressure conditions, the apparatus will operate with various other pressure conditions. The multiple chambered switch structure provides a highly effective and universal snap-action switch device.

Further, the invention is particularly adapted to a modular type of a construction using the annular wall structure, the switch actuators, the contact spring and the diaphragms to provide alternate constructions and switch operations.

In addition, the switch unit can be made to respond in various modes including a single pressure source. For example, the illustrated dual pressure system may be used to produce sequential switching in response to successive pressure signals as shown in phantom in FIG. 1. A single pressure source 86 is shown coupled to the input element 87 of a two way valve unit 88 having a first output element 89 and a second output element 90. The output element 89 is connected to the input element of end pressure plate and the output element 90 is connected to the input element of plate 3. The input pressure element 87 is also coupled to a valve operator 91 to change the valve setting in response to each pressure input signal. Thus, connection of input element 87 to output element 89, the next pressure signal, actuates the valve to close the existing connection and switch the connection of input element 87 to output element 90. The next following or second pressure signal reverses the latter connection and so forth for the following signals.

Figure 6:
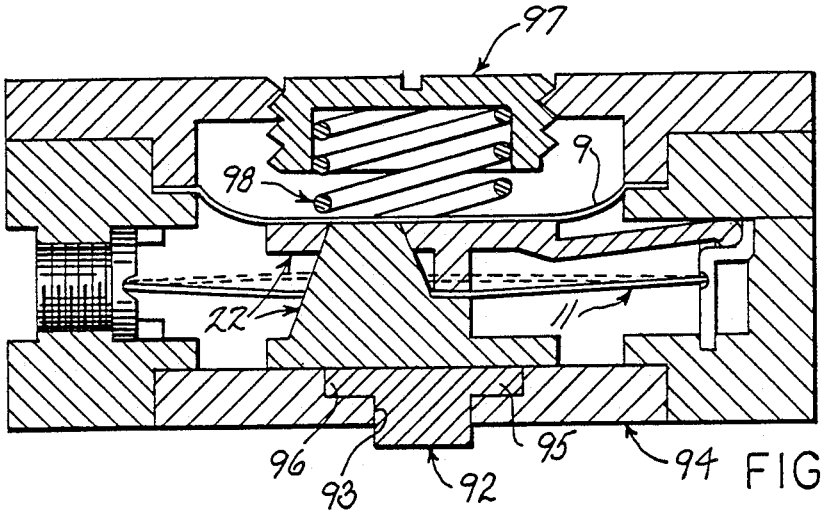
FIG. 6 is a view similar to FIG. 3 illustrating a pressure switch similar to that of FIGS. 1–5 modified to includes a manual reset.

For example, the switch structure shown in FIGS. 1–5 can be readily converted to a switch structure requiring a manual reset such as shown in FIG. 6. In this embodiment, the one coil spring and pressure chamber including the diaphragm 10 have been eliminated. A push-button unit 92 is inserted within the opening 93 in an end wall unit 94. The inner end of the push-button unit 92 abutts the adjacent actuator unit 23*a*.

In the embodiment, the end wall unit 94 is modified to provide a simple, flat abuttment. The inner face of the end wall is recessed as at 95 adjacent the reset button opening. The button unit 94 in turn includes a flange 96 mating with the circular recess. The opposing spring and fluid pressure on the coupling member, as generated by the spring and pressure assembly 97 to the opposite side of the switch unit holds the push-button unit 94 in position within the opening.

The spring unit 98 of assembly 97 is set to establish the fixed position shown in the drawing. The coil spring maintains the switch mechanism in the snapped position. Thus, pushing the button inwardly causes the center of the contact spring, particularly the actuator arm, to move pass the center position resulting in a snap action resetting of the contact spring and the contact to engage the alternate contact. Assuming the pressure has been relieved sufficiently, the contact will maintain its reset position. Once the unit is reset by pushing the push-button unit 94 to arch the spring upwardly, the pressure in the pressure chamber must increase to change the position of the switch mechanism.

Although illustrated with reset button 92, the system can be constructed with the spring member 11 characteristic and mounting to establish and maintain a bias to an initial set with position with the alternate position created in response to a selected pressure level. If the pressure is reduced below that level or some degree below if the system has hysterises, the spring member would reset directly to the biased initial position. The reset button unit 94 may then be eliminated and the corresponding end of the intermediate wall unit closed by a plate member.

Other modifications can be readily made in a switch assembly using the same basic components. Thus, a series sequence control pressure differential switch unit is shown in FIG. 7 wherein the electrical components are isolated from the pressure medium creating or the pressure signal. In the illustrated embodiment, a single pressure control is provided with the set point established by a coil spring construction independently set for each of the switch mechanisms.

In the illustrated embodiment of FIG. 7, a pair of annular intermediate sidewall units 100 and 101, each generally corresponding to the wall unit 8 in the first embodiment are assembled in stacked relation to the opposite sides of a center annular pressure wall unit 102. In the embodiment of FIG. 7, the walls are shown as single piece annular walls having opposed spring mounting slots formed in the walls, and illustrate an alternate modular construction. The wall unit 102 is constructed to mate with the end faces of the units 100 and 101. A first diaphragm 103 is located between the first annular intermediate wall unit 100 and the wall unit 102. A similar diaphragm 104 is interposed between the second intermediate wall unit 101 and the pressure chamber wall unit 102. A single pressure chamber 105 is formed directly between the two diaphragms 103 and 104 and the housing or wall unit 102. The diaphragm 103 and 104 both respond to the single input pressure applied through the single inlet 106 formed in the pressure wall unit 102. A switch assembly similar to that previously described is mounted within each wall unit 100 and 101. Referring to the wall unit 100, opposed switch actuator members 107 and 108 are slidably disposed therein to the opposite sides of a multiple arm spring 109 interposed and coupled to the interior wall of unit 100 generally as in the first embodiment. Thus, the illustrated spring 109 is mounted at the opposite ends to the opposite sides of the contact spring housing and includes a contact arm 109*a* and an actuator arm 109*b* secured to the mounting frame. The outer face of the wall unit 100 is sealed by an end wall unit 110 shown as a simple stepped end wall similar to that shown in the manual reset wall structure. An adjustable coil spring unit 111 in unit sets the pressure on the contact spring 109.

The opposite wall unit 101 is essentially a duplicate of wall unit 100 and is similarly assembled to the pressure chamber wall unit 102 with a contact spring 112 similarly mounted and with an adjustable coil spring unit 113 for setting the pressure level response diaphragm 104. The spring member 109 is also modified such that the actuating arm is a closed member at least at the point of engagement with the element 114 of spring member 107 and 108. The opposed actuator members 107 and 108 thus clamp the spring actuator arm therebetween and position the arm in accordance with the present force of the unit 111 and the pressure force applied via the diaphragm 103. The multiple arm spring may otherwise be constructed in the same construction as in the prior embodiment, or in any other suitable configuration wherein the deflection of the actuation arm is transmitted to the spaced contact arm. Further, in the embodiment of FIG. 7, the actuator member 107 and 108 illustrated an alternate embodiment of the invention in which the actuator members are similar devices. Referring to actuator member 107, the member includes a base wall having a configuration complementing the opening of the switch housing. An actuator projecting element 114 is located centrally of the base wall. Element 114 is a conically or pointed member and establishes a point contact to the actuator arm 115 of the spring 109.

In FIG. 7, the switch apparatus is shown with pressure applied to the pressure chamber. The contact spring 109 and 112 are shown similarly arched to engage with the one diaphragm in the planar position and with the other diaphragm deflected. The switch contacts are shown engaging the same fixed contacts in full line illustration. Each of the coil springs is set to respond to a particular pressure.

In a sequence system, it is assumed that the contact assembly shown to the bottom side in FIG. 7 responds to the lowest pressure. Thus, as the pressure in the pressure chamber increases, the pressure on the diaphragm 104 opposes that of the coil spring and moves the contact arm of contact spring 112 toward the center position. When the pressure rises to the switching level, the actuator arm moves past the center position, resulting in the snap action movement of the contact assembly to the full line position illustrated.

At this pressure, the character of the contact spring 109 to the opposite switch assembly maintains the associated switch in the set position with the diaphragm in the flat initial position. Depending upon the setting of the coil spring, further pressure in the pressure chamber results in the sequential movement diaphragm 104 and the opposite switch assembly with a resulting snap action response at some higher pressure.

Although described as a snap action response mechanism, either one or both of the switch units could of course be set to respond in a proportionate manner, with an intermediate period during which the contact was not engaging either one of the main contacts, as previously discussed.

Although sequence switches are known, the illustrated switch is unique in providing a basic modular type of construction using the intermediate wall, the actuators and contact spring used in the various other switch configurations. Although the end walls are shown somewhat modified, the wall unit could be constructed using essentially a single end wall structure similar to that for the spring-loaded push button reset unit of FIG. 6 to further minimize the part requirements.

As previously noted, the contact spring may of course take other various forms. For example, a different contact spring providing a similar basic response is shown in FIG. 8.

In the second spring embodiment, a contact spring is formed with a ring-shaped outer supporting frame 116. The end connecting members 117 and 118 are integrally formed with the ring and project outwardly on diametrically opposite sides thereof much in the manner of the first embodiment. A pair of lateral or chordal spring arms or members 119 and 120 are integrally connected to the edge of the ring frame 116. The first member 119 is located adjacent the central portion of the ring on an axis generally perpendicular to that of the connection members 117 and 118. The center member 119 forms a contact actuator with the actuator engagement point 121 located essentially centrally of the ring frame 116. A contact 122 is secured to the contact arm or member 120 which is secured in offset relation and parallel to the actuator arm 119.

Both arms are shown with apertures or openings to control the characteristic of the spring arm. Thus, the actuator arm 119 is shown having a plurality of equally spaced openings 123 along the outer edge of the arm. The contact point 121 is spaced more closely adjacent to the opposite non-apertured edge.

The contact arm 120 is provided with a pair of openings 124 to each side of the contact in equal spaced relation thereto.

In accordance with well known construction, the differential pressure sensed by anyone of the differential switch constructions may be between two positive pressures, two negative pressures, relative positive and negative pressure with respect to each other and/or with respect to atmospheric pressures. Thus, the particular application or pressures will be dependent upon the particular application of the switch structure. With the isolated construction, the pressure fluids can be of any desired medium. Thus, the switch mechanism is totally isolated from the fluid pressures and the switch structure will readily adapted widely varying fluids. Thus, the housing structures are readily formed of an appropriate suitable plastic material or the like, but can be of any other materials including non-conductive metals, ceramics or the like. Similarly, diaphragms are readily available for use with many various fluids.

The present invention will operate at a wide range of source pressures and over a wide range of different differential pressures. With appropriate construction of the spring mounting, the differential pressure can be adjusted directly in any given particular switch. The switch structure can thus function in a set reset mode, a latching mode or flip-flop mode, a staging or sequence mode, or the like by appropriate construction and setting of the spring tension and with appropriate end closure members. The complete isolation of the electrical mechanism from the pressure chamber also provides desirable in various applications where the fluid would adversely effect the conductive material of the switch mechanism.

The adjustable differential is provided by the completely two separate coil springs coupled to the opposite sides of the operators in the illustrated embodiment. Thus, by mere adjustment of the spring, the pressure can be added or reduced in each chamber. This permits very close adjustable adjustment of the differential range and allows the adjustment over a wider range of spring tensions. With the spring switch unit readily applicable to various switch applications essentially independent of the particularly fluids encountered, it provides a very versatile basic design. The users thus will have intimate knowledge of the switch structure and its functioning and can readily apply the same in various environments. Thus, the present invention is readily applied to both low pressure inputs, low pressure differential, high pressure inputs, high pressure differentials in contrast to the usual special processed design such as shown in prior art.

Thus, although the present invention is particularly adapted to a very small miniaturized valve structure for use in low pressure differential applications, it has many other wide usages in various other environments.

In summary, the present invention is particularly directed to a modular fluid activated switch construction including a separate conductive switch module within which a contact spring unit is mounted with a switch actuator unit coupled to an actuator arm of the spring unit for positioning of a first contact member of the spring unit relative to other relatively fixed contact member or members in combination with end closure modules which close the contact spring chamber and provide for various modes of moving the contact actuator in said chamber, either through pressure responsive movable wall members, mechanically actuated operators or the like. The end closure modules may establish any of many different operative forces on the contact actuator, but each is formed to similarly attach to and close the opposite sides of the switch module.

Various modes of carrying out the invention are contemplated as being within the scope of the following claims particularly pointing out and distinctly claiming the subject matter which is regarded as the invention.

I claim:

1. A pressure switch apparatus for responding to widely different fluid pressure signals, comprising an annular contact spring wall unit having a through opening extended therethrough with a continuous outer wall, spring support members secured to diametric opposite portions of said continuous wall, a multiple arm contact spring having first and second outwardly extending connection ends secured to said support members, said contact spring having a frame member and a generally centrally located actuator arm and a spaced and laterally offset contact arm, a contact actuator unit within said opening and with a first contact actuator located to one side of said contact spring and a second contact actuator located to the opposite side of said contact spring, each of said actuators including a projecting spring engaging portion engaging one side of said actuator arm, said spring having a total length between the connection ends in excess of the spacement of said support members whereby said contact spring is arched within said opening with the connection ends secured to the support members, said contact arm being located in a first position engaging one of said contacts with the contact spring arched in a first direction within said opening and a second position spaced from said first position with said contact spring arched in the opposite direction from said first direction within said opening, end closure members secured to the opposite ends of said spring wall unit and closing said opening, and a diaphragm secured between said wall unit and one of said end closure members in parallel relation to said first contact actuator and in abutting engagement with said first contact actuator to define a pressure chamber.

2. The pressure switch apparatus of claim 1 wherein said frame member is an encircling member having connecting end arms and side arms and with said contact arm secured to a side arm and said actuator arm secured to an end arm and located within the frame.

3. The pressure switch apparatus of claim 2 wherein said actuator arm has a central opening and said spring engaging portion of said contact actuators including a member extending through said central opening and lateral bar members extending laterally of the central opening at the opening.

4. The pressure switch apparatus of claim 1 wherein said contact spring wall unit includes a first housing member and a second housing member secured in abutting engagement, each housing member having a base wall with a corresponding opening defining said through opening and each having circumferentially spaced first and second aligned walls to form an enlarged chamber surrounding said through opening, a common contact embedded in one of said aligned walls and said last named wall having a contact spring recess, said recess forming a first of said spring support members, said spring having said first connection end secured within said spring recess, the second of said spring support members located in said second aligned wall aligned with said common contact, and said second connection end secured to said second spring support member.

5. The pressure switch apparatus of claim 4 wherein said second spring support member includes a movable member adjustably movable in a plane through said support members for varying the spacement between said support members.

6. A modular pressure responsive switch unit comprising a central switch housing wall including a central opening defining an axis of the housing wall and with a switch chamber within said housing wall, said housing wall having a first and a second flat axial end faces, a snap action spring member mounted within said switch housing wall and including a movable contact located within said switch chamber, a first closure plate unit secured to said first end face of said housing wall to close said switch chamber, said first closure plate unit including a recessed end plate and a diaphragm interposed between said switch housing wall and said first end plate and defining a pressure chamber to the exterior of said diaphragm, a second closure plate unit secured to the second end face of said switch housing wall to close said switch chamber, a spring coupling unit located within said switch housing wall and including a first actuator member to one side of said spring member and a second actuator member to the second side of said spring member, said first actuator member including a base portion abutting said diaphragm, said second actuator member including a base portion abutting said second end closure plate unit, each of said actuator members having a generally centrally located coupling member projecting inwardly into continuous engagement with a restricted spring operating portion of said snap action spring member whereby said actuator members are moved as a unit in response to the forces of said snap action spring member and said diaphragm to move said spring operating portion and thereby effect a snap action movement of said movable contact.

7. The switch unit of claim 6 wherein said second closure plate unit includes a second recessed end plate and a diaphragm interposed between the housing wall and the second recessed end plate and abutting the second member actuator base portion to define a second pressure chamber.

8. The switch unit of claim 7 including a pressure actuated valve unit connected to said first and second pressure chambers and having an input pressure element, said valve unit alternating pressure to said chambers.

9. The switch unit of claim 6 wherein an annular pressure wall unit is secured between said switch housing wall and said second closure plate unit, a first diaphragm and a second diaphragm closing the opposite ends of said annular pressure wall unit, said annular pressure wall unit being secured to said switch housing wall, a second switch unit secured abutting said second diaphragm and end of the annular pressure wall unit, and said second end closure plate secured to the outer end of said second switch unit.

10. The switch unit of claim 6 wherein said second closure end plate includes a movable member located to engage and to move said second base portion for moving said second actuator against the force on said diaphragm.

11. A pressure responsive sequential switch unit comprising an annular pressure housing closed on the ends thereof by first and second diaphragms, first and second switch housings secured to each end of the pressure housing, each of said switch housing having an inner wall member and an outer wall member, each of said wall members having an aligned central opening and defining a spring chamber, each said inner wall member abutting said diaphragm and having an annular base and a first and second upstanding wall portion located on opposite sides of said opening and having recesses between said first and second upstanding wall portion, said outer wall member having an annular base and a third and fourth upstanding wall portion complementing and mating with the recesses between the first and second wall portions of said inner wall member whereby assembly of said inner and outer wall members defines said spring chamber, said inner wall member having a contact chamber projecting from and forming an extension of said spring chamber, said first wall portion of said inner wall member including a spring support element adapted to support an end of a leaf spring, said second wall portion including a terminal member having a support element adapted to receive and support an end of a leaf spring member, each of said first and second switch housings further including a multiple armed leaf spring member having a length between opposite ends greater than the length between said support elements, said spring member being formed of a conductive flexible material and located within said spring chamber with said opposite ends coupled to said spring support elements, said spring member being arched to one side of a plane through said spring support elements, a spring actuating unit located within said spring chamber, said spring actuating unit including first and second actuator members located one each to the opposite sides of said spring member within said chamber, said first spring actuator member including a base portion located abutting the diaphragm closing said pressure housing and located within said spring chamber and having an inward projection projecting inwardly into operative engagement with said leaf spring and particularly said spring actuating arm, said second actuator member having a base portion located within said spring chamber and having an inward projection aligned with said projection of said first spring actuator member and coupled to said spring member in alignment with said first projection whereby said actuating arm is clamped between said projections, said spring member biasing said actuating unit to a first position, opposite first and second end wall units secured respectively to the exterior of said first and second switch housings and closing of said spring chambers and at least one of said end walls including an operator engaging the adjacent actuator member and operative to move the actuator member and said spring actuating arm to move said spring member from said first position.

12. The switch unit of claim 11 wherein said second wall unit includes a pressure chamber, a diaphragm unit is interposed and claimed between the second end wall unit and a second outer wall member to define a second pressure chamber operative to the opposite side of said spring from said first pressure chamber for establishing an opposing force on said spring actuator arm.

13. The switch unit of claim 11 wherein each of said contact spring members includes a circular frame having mounting projections on diametric opposite exterior edges from establishing a leaf spring mounting of the spring member, first and second cordal arm members interclave formed with said circular frame and axially and spaced from each other, said actuator being coupled to one of said arms, and at least one contact secured to the second of said arms.

14. A modular fluid activated switch apparatus, comprising an electric switch module and having opposite end walls and having a central opening terminating in said end walls and defining a contact and spring chamber, a spring located within said contact and spring chamber and having an actuator arm, a movable contact secured to said spring in spaced relation to said actuator arm, a fixed contact secured to said module in the path of said movable contact, a switch actuator unit coupled to said actuator arm for positioning of said movable contact relative to said fixed contact, a plurality of end closure modules connected to the opposite ends of said switch module and closing said chamber, and said end closure modules including operative elements connected to said actuator arm and including input control connected to said operative element and establishing the force moving the actuator and thereby said actuator arm, at least one of said end closures modules secured to one end of said electric switch module having a movable wall member positively movable in response to fluid pressure and establishing a sealed pressure responsive operator coupled to move said actuator arm in one direction at least a second of said plurality of said end closure modules secured to the opposite end of said switch module and including an operative element coupled to said actuator arm and movable against the force of said fluid pressure for establishing an opposing force on the actuator arm and each end closure module being constructed for attachment to and closing the opening of said switch modules.

* * * * *

UNITED STATES PATENT AND TRADEMARK OFFICE

CERTIFICATE OF CORRECTION

PATENT NO. : 5,001,317

DATED : March 19, 1991

INVENTOR(S) : LOUIS D. ATKINSON ET AL

It is certified that error appears in the above-identified patent and that said Letters Patent is hereby corrected as shown below:

Column 18, line 38, claim 12, delete "claimed" and substitute therefor ---clamped---.

Signed and Sealed this

Twenty-seventh Day of October, 1992

*Attest:*

DOUGLAS B. COMER

*Attesting Officer*

*Acting Commissioner of Patents and Trademarks*